United States Patent [19]

Green, Sr.

[11] Patent Number: 4,727,806

[45] Date of Patent: Mar. 1, 1988

[54] PIN REGISTER SYSTEM FOR FLEXOGRAPHIC PRINTING PLATES

[75] Inventor: Eugene L. Green, Sr., Dallas, Tex.

[73] Assignee: Wilson Engraving Company, Inc., Dallas, Tex.

[21] Appl. No.: 14,109

[22] Filed: Feb. 3, 1987

Related U.S. Application Data

[62] Division of Ser. No. 769,367, Aug. 26, 1985, abandoned.

[51] Int. Cl.[4] ..... B41F 27/12

[52] U.S. Cl. ..... 101/415.1

[58] Field of Search ..... 101/401.1, DIG. 12, 101/375, 376, 415.1, 378, 401.3; 33/184.5

[56] References Cited

U.S. PATENT DOCUMENTS

| | | | |
|---|---|---|---|
| 3,103,880 | 9/1963 | Sanford et al. | 101/DIG. 12 |
| 3,347,162 | 10/1967 | Braznell et al. | 101/415.1 |
| 3,430,561 | 3/1969 | Simmons | 101/415.1 |
| 4,018,528 | 4/1977 | Dennis | 101/DIG. 12 |
| 4,259,904 | 4/1981 | Metje | 101/DIG. 12 |
| 4,467,722 | 8/1984 | Klingelhoefer | 101/415.1 X |
| 4,489,652 | 12/1984 | Takeuchi et al. | 101/DIG. 12 |
| 4,582,768 | 4/1986 | Takeuchi et al. | 101/DIG. 12 |
| 4,589,338 | 5/1986 | Collins et al. | 101/415.1 |

FOREIGN PATENT DOCUMENTS

| | | | |
|---|---|---|---|
| 3129418 | 4/1983 | Fed. Rep. of Germany | 101/DIG. 12 |
| 3238167 | 4/1983 | Fed. Rep. of Germany | 101/DIG. 12 |
| 2109306 | 9/1968 | United Kingdom | 101/DIG. 12 |
| 2059627 | 6/1971 | United Kingdom | 101/401.1 |
| 2083411 | 3/1982 | United Kingdom | 101/415.1 |
| 1128207 | 3/1983 | United Kingdom | 101/DIG. 12 |
| 1234761 | 6/1983 | United Kingdom | 101/DIG. 12 |

*Primary Examiner*—J. Reed Fisher

*Attorney, Agent, or Firm*—Dennis T. Griggs

[57] ABSTRACT

A method for accurately positioning photopolymer color plates onto print cylinders of a rotary press is disclosed. The photopolymer plates are prepared with the aid of specially prepared color separated films and are mounted onto assigned print cylinders with the aid of index pins. Alignment accuracy is provided in part by producing each color separated film from the same camera film negative on which an image field and reference marks have been photographically transferred from mechanical artwork. Continuity of alignment accuracy is provided by center scribe reference marks utilized together with index holes which are precision located and punched, respectively, onto and through carrier sheets, masks, duplicating film and color separated negatives. Various combinations of pre-punched carrier sheets, masks, contact duplicating film, color separated negatives, and unexposed printing plates are mechanically coupled in precise alignment by pin register tabs throughout the various stages of the plate production process. In particular, superimposed sheets are coupled together and center scribe marks are maintained in alignment by pin register tabs which are received in registration in the precision punched index holes.

1 Claim, 15 Drawing Figures

PIN REGISTER SYSTEM FOR FLEXOGRAPHIC PRINTING PLATES

CROSS REFERENCE TO RELATED APPLICATION

This is a divisional of application Ser. No. 769,367, filed Aug. 26, 1986, now abandoned.

FIELD OF THE INVENTION

This invention relates generally to the art of color printing, and in particular to method and apparatus for precisely locating a flexographic printing plate onto a print cylinder.

BACKGROUND OF THE INVENTION

In the art of flexographic color printing, photoengraved photopolymer plates are used in multiple processes. The first step in preparing color printing plates is to make a camera film negative from camera ready art (mechanical art). Multiple color separated film negatives are then produced from the camera film with the aid of a mask for line processes, or with the aid of color filters for half tone processes. After the color separated negatives are developed, the color separated image is photographically transferred to a photosensitive plate, with a separate photopolymer printing plate being produced for each color. The exposed plate is then etched to define the printing surface. Non-printing areas on the plate are removed by the etch solution, leaving the printing surface standing in relief.

The finished plates are thereafter separately mounted onto print cylinders. The plates are inked and applied to separate sheets or a moving webb of printing paper or film, with the print fields of the various plates being superimposed upon one another. Thus, the picture is successively built up step-by-step, and when the impressions are properly superimposed, the resulting print is a faithful reproduction of the mechanical art.

To achieve good results, it is essential that the successive print fields register exactly one upon the other, with the separate color impressions being spaced with respect to each other so that overlapping does not occur. The complementary printing plates must be precisely aligned to obtain appropriate positioning of the multiple color impressions. Therefore, it is essential that the print fields of the flexographic plates be aligned within very close tolerances at corresponding locations on each print cylinder.

DESCRIPTION OF THE PRIOR ART

According to conventional practice, the location and mounting of a flexographic printing plate onto a print cylinder is carried out manually by aligning index (scribe) marks on the plate with corresponding index (scribe) marks which are scribed onto the surface of the print cylinder. Plate alignment accuracy depends largely upon personal judgment; significant alignment errors can be induced by the "parallax" effect. The alignment procedure is complicated by the presence of a bonding agent which secures the printing plate onto the cylinder.

Typically, double-sided adhesive tape is utilized for securely bonding the photopolymer plate onto the surface of the print cylinder. That is, the adhesive is a contact adhesive which bonds rapidly thereby limiting the amount of adjustment displacement of the photopolymer plate after initial contact. It is usually necessary to perform one or more trial printing runs and adjust the position of one or more of the color plates to achieve an acceptable color print. The adjusting process may take several man-hours. It will be appreciated that the foregoing conventional plate mounting procedure requires a high level of skill and experience to be carried out effectively.

SUMMARY OF THE INVENTION

According to the invention, plate alignment accuracy is provided in part by producing each color separated film from the same camera film negative on which center scribe marks and registry marks have been photographically transferred from mechanical artwork. Continuity of alignment accuracy is provided by a system of center scribe reference marks utilized together with index holes which are precision located and punched, respectively, onto and through carrier sheets, masks, duplicating film and color separated negatives. Various combinations of pre-punched carrier sheets, masks, contact duplicating film, color separated negatives, and unexposed printing plates are mechanically coupled in precise alignment by index pin tabs throughout the various stages of the plate production process. In particular, superimposed sheets are coupled together with corresponding scribe marks being held in alignment by index pin tabs which are received in registration in the precision punched index holes.

Multiple photosensitive plates are finished with the aid of the specially prepared color separated films, and the finished plates are precisely aligned and securely mounted onto print cylinders with the aid of a pair of index pins. The index pins are mounted onto each print cylinder at a precise spacing distance "L". Each print cylinder of the color print sequence is equipped with the index pins mounted at mutually corresponding locations. A pair of index holes are punched at a corresponding distance "L" through each color plate along a major axis thereof. Each color plate is thereafter mounted onto a print cylinder with the index pins received in registration with the index holes.

Because of the precision provided by the method of the invention, no further adjustment of one plate relative to another is required. With all plates and print cylinders being set up in this manner, the successive impressions produced by the superimposed printing fields are properly spaced, thereby providing faithful reproduction. Moreover, the entire plate mounting procedure can be carried out by one person in less than an hour per plate.

The advantages of the invention will be further appreciated by those skilled in the art upon reading the detailed description which follows in conjunction with the attached drawings.

DETAILED DESCRIPTION OF THE PREFERRED EMBODIMENT

Figure 1:
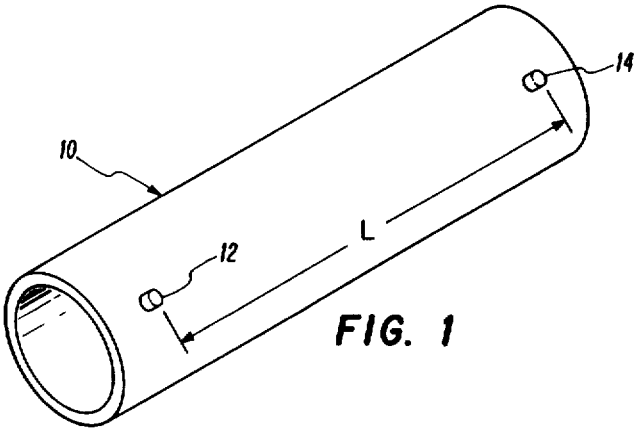
FIG. 1 is a simplified perspective view of a print cylinder on which index pins have been mounted.
Figure 2:
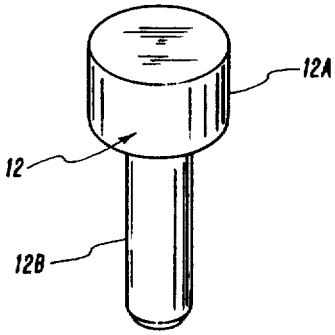
FIG. 2 is a perspective view of a cylinder index pin.
Figure 3:
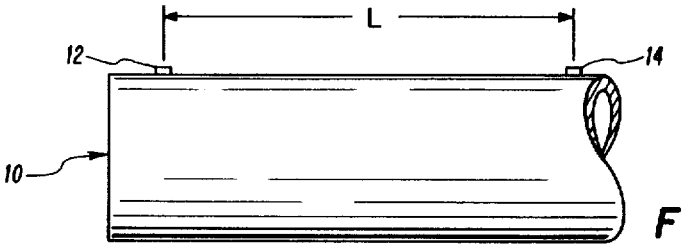
FIG. 3 is a front elevational view of the print cylinder shown in FIG. 1.

In the description which follows, like parts are indicated throughout the specification and drawings with the same reference numerals, respectively. The drawings are not necessarily to scale and the proportions of certan parts have been exaggerated to better illustrate details of the present invention.

Figure 13:
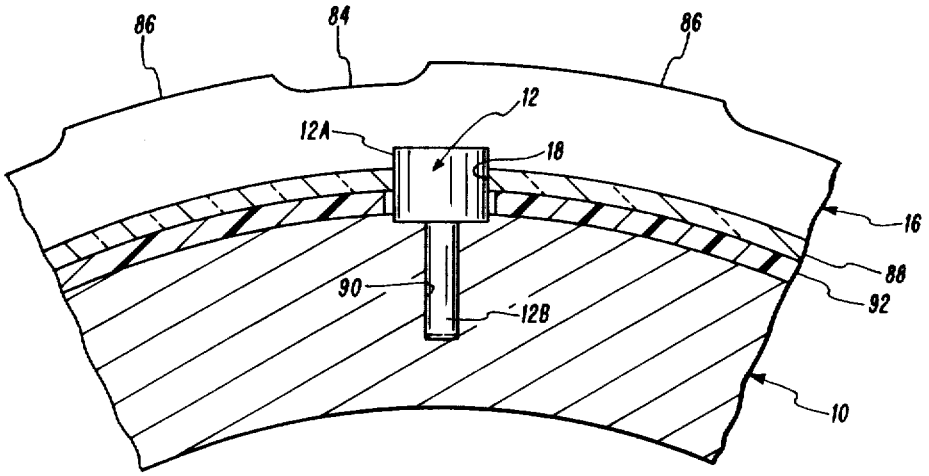
FIG. 13 is a sectional view of a print cylinder onto which the photopolymer plate of FIG. 12 is mounted according to the teachings of the present invention.

Referring now to FIGS. 1, 2, 3 and 13, a print cylinder 10 of a rotary press having multiple print cylinders for producing multi-color prints is modified by the attachment of a pair of index pins 12, 14. As can best be seen in FIGS. 2 and 13, the index pins 12, 14 are mounted onto the print cylinder in an upright orientation, and at separate locations which are precisely spaced at a distance L. The index pins may be attached by slip socket engagement as shown in FIG. 13, or by threaded engagement. In some instances, it may be desirable to remove the pins after a flexographic plate has been secured. It may be desirable to utilize such pins for hold-down purposes as well as for indexing purposs, in which case they are retained during the printing process. However, the primary function of the pins 12, 14 as utilized herein is for indexing purposes, as described in greater detail hereinafter.

Figure 12:
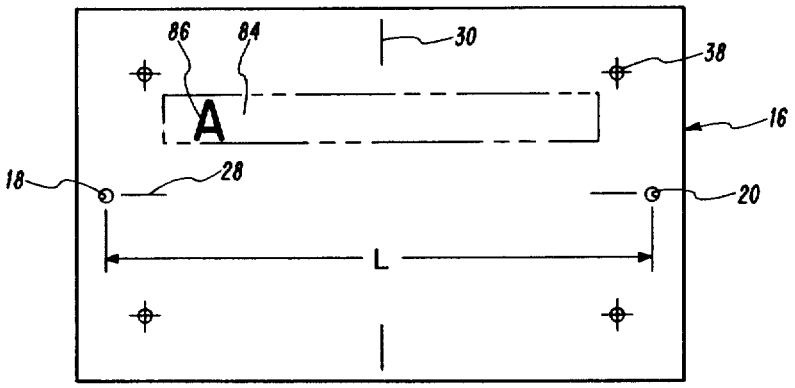
FIG. 12 is a top plan view of a flexographic printing plate having a color separated print surface exposed through the color separation negative of FIG. 9.

Referring to FIGS. 12 and 13, a flexographic photopolymer plate 16, prepared according to the teachings of this invention, is mounted onto the print cylinder 10 with the index pins 12, 14 of the print cylinder being received in registration with index holes 18, 20. The index holes 18, 20 are formed in the plate 16 at a precise spacing distance "L" which corresponds with the spacing distance of the cylinder index pins. The index holes 18, 20 formed in the photopolymer plate 16 are carefully located according to the following method.

Figure 9:
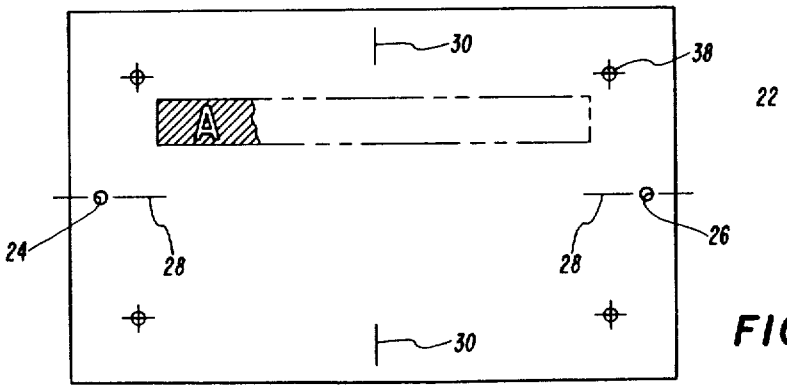
FIG. 9 is a top plan view of a color separated negative prepared pursuant to the mask exposure step of FIG. 8.

The locations of the plate index holes 18, 20 corresponds exactly with the location of a corresponding set of index holes 24, 26 formed in a color separated film negative 22 (FIG. 9). According to the method of the invention, the index holes 24, 26 are precisely located with respect to center scribe marks 28, 30 which are photographically transferred from corresponding scribe marks on camera ready mechanical artwork 32 (FIG. 4).

Figure 14:
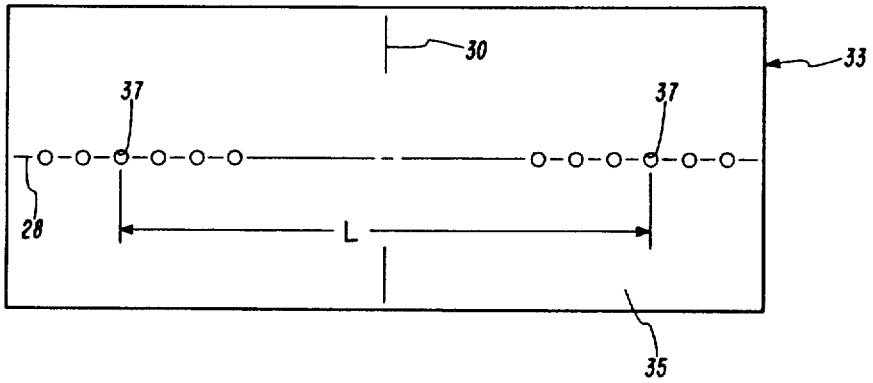
FIG. 14 is a top plan view of a precision punch table having a work surface onto which horizontal and vertical scribe marks are formed; and, FIG. 15 is a perspective view of a printing press cylinder having a photopolymer plate mounted with the aid of index pins.

The index holes 24, 26 are spaced at a distance "L" and are formed on a precision punch table 33 (FIG. 14). The precision punch table 33 has a work surface 35 on which a corresponding set of horizontal and vertical center scribe marks 28, 30 are formed. Multiple sets of die openings 37 are formed in the punch table at symmetrically-spaced locations about the vertical center scribe line 30, and are coincident with the horizontal center scribe line 28. The center scribe marks 28, 30 of the color separated negative 22 are superimposed in alignment with the corresponding center reference marks on the punch table 33, and the holes 24, 26 are punched at equally spaced locations with respect to the vertical scribe mark 30, and coincident with the horizontal scribe mark 28.

Figure 4:
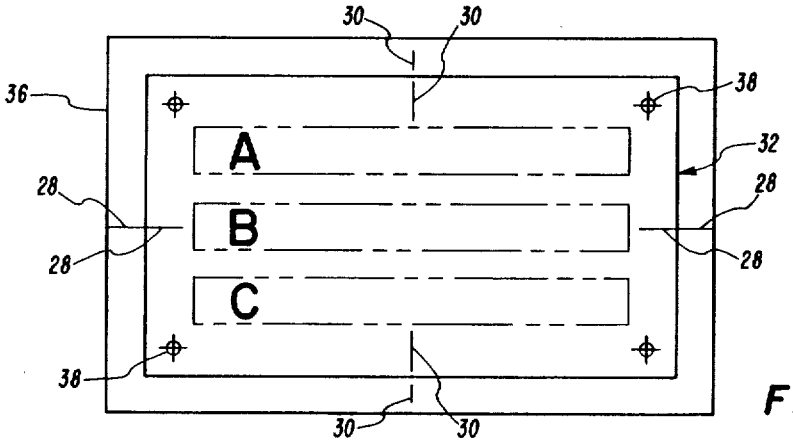
FIG. 4 is a simplified top plan view of camera ready mechanical artwork.
Figure 5:
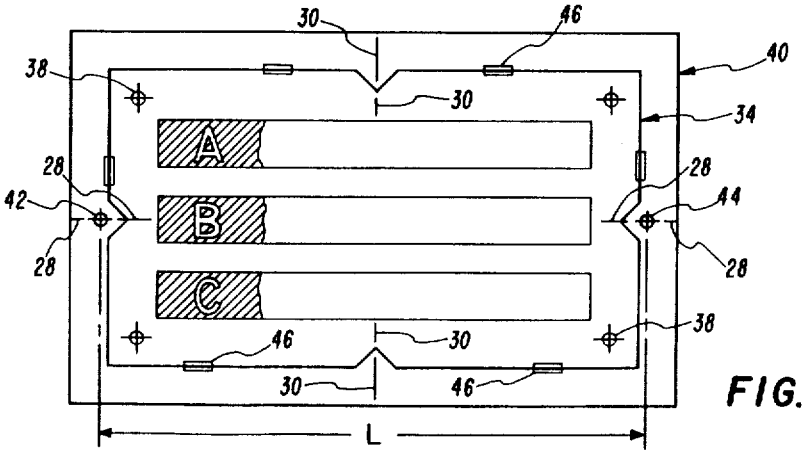
FIG. 5 is a simplified top plan view of a camera film negative prepared from the mechanical artwork of FIG. 4.
Figure 6:
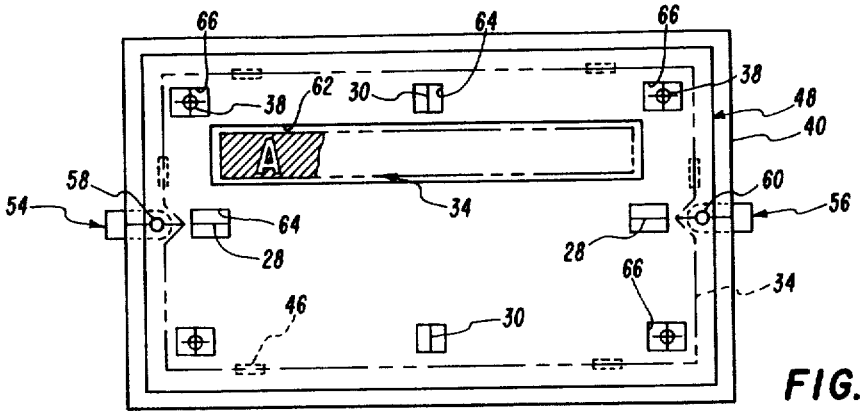
FIG. 6 is a top plan view of a color separation mask superimposed over an assembly of camera film and unexposed duplicating film.

A preliminary step is to prepare a film negative 34 (FIG. 5) from the camera ready mechanical artwork 32 (FIG. 4). The camera ready artwork 32 is attached to a base carrier sheet 36 on which horizontal scribe marks 28 and vertical scribe marks 30 have been formed. Corresponding horizontal and vertical center scribe marks 28, 30 are also formed onto the camera ready mechanical artwork 32. The mechanical artwork 32 is taped onto the base carrier sheet 36 with the corresponding horizontal and vertical center scribe marks in alignment. Additionally, cross-hair register marks 38 are applied to each corner of the camera ready mechanical artwork.

The mechanical artwork 32 includes three separate image fields designated A, B and C. For purposes of this description, it is assumed that each image field is intended to be reproduced in different colors. Accordingly, for this example, it will be necessary to prepare three separate color separated films from which three different printing plates are produced.

For purposes of illustration, the description which follows is directed to the method for preparing a printing plate for reproducing the image field A. After the camera film negative 34 has been prepared from the mechanical artwork 32, the camera negative 34 is attached to a base carrier sheet 40 onto which horizontal and vertical scribe reference marks 28, 30 have been formed. Additionally, index holes 42, 44 are precision punched at equally spaced locations with respect to the vertical scribe mark 30, and coincident with horizontal scribe mark 38. The index holes are spaced at a distance "L", which corresponds exactly with the center-to-center spacing of the index pins 12, 14 which are mounted onto the print cylinder 10.

The side portions of the film negative 34 are notched to provide clearance for the index holes and to reveal the underlying center scribe marks. Additionally, the film 34 is mechanically attached to the base carrier sheet 40 by small strips of tape 46 which are applied along the edge portions of the film negative at locations outside of the image fields.

It should be noted that the subject matter appearing on the camera ready artwork 32, including the center scribe marks, cross-hair register marks and image field A is reproduced in photographically negative relation on the camera film 34. That is, the letter A appears in solid black format surrounded by a transparent field in the mechanical artwork 32, whereas in the negative film 34, the letter "A" appears in transparent form, surrounded by an opaque field. Likewise, the center scribe marks and cross-hair register marks also appear as a clear transparency area on the negative, with all other areas of the negative being opaque. However, to simplify illustration, such other opaque areas of the film negative 34 have been omitted.

The horizontal and vertical center scribe marks 28, 30 formed onto the base carrier sheet 40 should be accurately located. To improve accuracy, a photo-mechanical scribing device such as a computer plotter or an opto-copy machine can be used to apply the center scribe marks onto the mechanical art, the base carrier sheets and the unexposed photopolymer plate.

Prior to taping the camera film negative 34 onto the base carrier sheet 40, the index holes 42, 44 are precision punched through the base carrier sheet along the horizontal center scribe line 28. After the index holes have been punched, the film negative 34 is taped onto the carrier sheet 40 with the respective cross-hair register marks and horizontal and vertical center scribe marks in alignment. The alignment of the film negative 34 is performed on a light table which enables the operator to see thorugh the film and the carrier sheet to line up the reference marks.

Referring now to FIGS. 6, 7, 8 and 9, a mask 48 of opaque sheet material is punched to produce index holes 50, 52 at a spacing distance "L". The mask 48 is placed on top of the film negative 34 with its index holes 50, 52 being in registration with corresponding index holes 42, 44 of the film carrier 40. The mask 48 is mechanically coupled to the base carrier/film negative assembly by pin register tabs 54, 56. The pin register tabs 54, 56 carry upright index pins 58, 60, respectively.

The mask 48 is made of an optically opaque material which completely obscures the underlying film negative 34. Accordingly, a window 62 is cut into the mask 48, thereby revealing the image field A. Additionally, small windows 64 are cut into the mask to reveal the underlying horizontal and vertical center scribe marks 28, 30. Other windows 66 are cut in corner locations to reveal the cross-hair scribe marks 38. The foregoing arrangement serves as a color separation technique for the film. That is, the large window exposes the area of the negative which is to be printed in a certain color. The smaller windows allow the center scribe marks and register marks to be printed onto the color separated negative.

Figure 7:
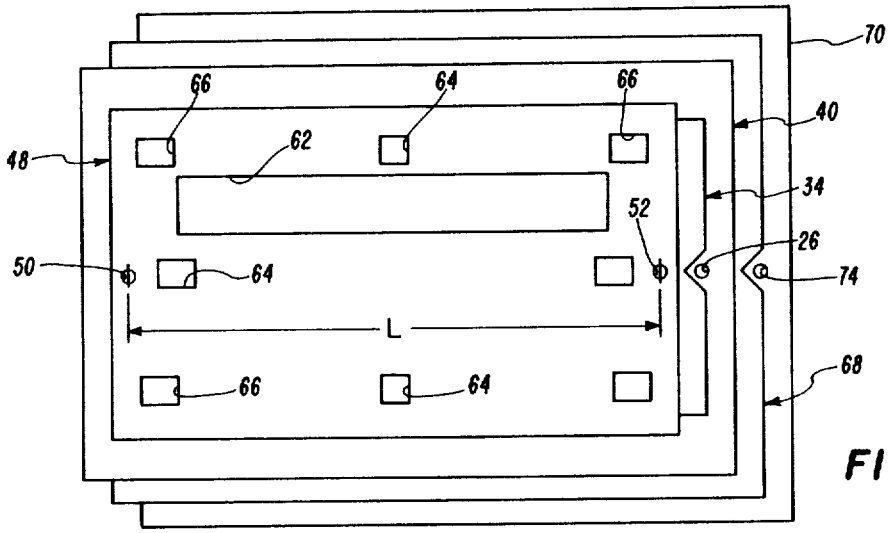
FIG. 7 is an exploded view of the film assembly shown in FIG. 6.
Figure 8:
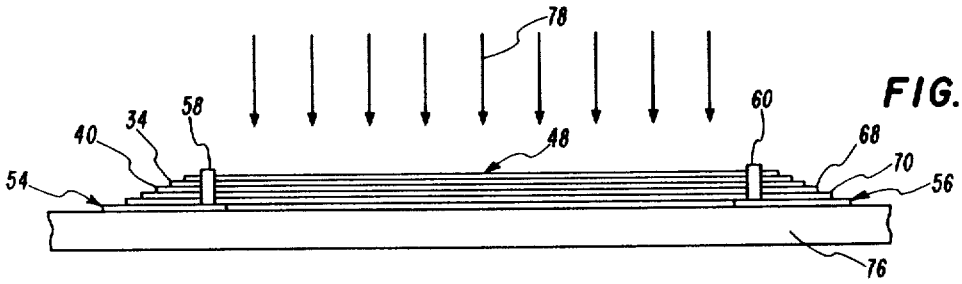
FIG. 8 is a side elevation view of the film assembly of FIG. 6 undergoing exposure.

The film negative 34, the mask 48 and the pin register tabs 54, 56 are used in combination with a sheet 68 of unexposed contact duplicating film as shown in FIGS. 7, 8. The contact duplicating film 68 is taped onto a base carrier sheet 70 having holes 72, 74 pre-punched on a precision punch table at corresponding locations which are spaced at a distance "L". The contact duplicating film 68 is placed in "emulsion-up" orientation and in contact with the under side of the transparent base carrier sheet 40.

The carrier sheets together with the film negative, the contact duplicating film and the mask are coupled together in superimposed relation by the pin register tabs 54, 56, with the index pins 58, 60 being received within the vertically aligned index holes at each end of the assembly. The coupled assembly is then placed on a vacuum hold-down table 76 where it undergoes exposure to a source of ultraviolet light 78. After exposure for a predetermined period, the contact film is removed from the assembly and developed to produce the color separated negative 22 as shown in FIG. 9. It should be understood that the foregoing procedures are followed for each additional color as desired. For example, for a six-color job, six contact film duplicates are made with the aid of six different masks, one for each of the six colors. The result in each case would be a separate color separated negative of the type illustrated in FIG. 9, but with a different print field exposure.

It should be noted that the color separation negative 22 as shown in FIG. 9 is identical to the original camera film negative 34 with the exception that print fields B and C do not appear. Otherwise, the color separated film 22 includes the same horizontal and vertical center scribe marks 28, 30 and corner cross-hair register marks 38 which are identically located with respect to the corresponding reference marks on the original camera ready mechanical artwork 32.

The next step is to prepare an unexposed photopolymer printing plate by punching index holes 18, 20 at the same center-to-center spacing "L" as the indexing pin holes on the contact duplicating film 68. The photopolymer plate is larger than the field of reproduction so that the location of the index holes with respect to a single exposure axis is not critical. Preferably, however, the index holes should be located along and coincident with the horizontal exposure axis of the plate. After the index holes have been punched, the unexposed photopolymer plate is placed in an exposing frame with the index pins of pin register tabs projecting through the index holes. Next, the color separated film negative 22, which also has index holes punched, is placed over the pins, thereby locating the color separated image field A precisely on the photopolymer plate 16 in relation to the index holes.

Figure 10:
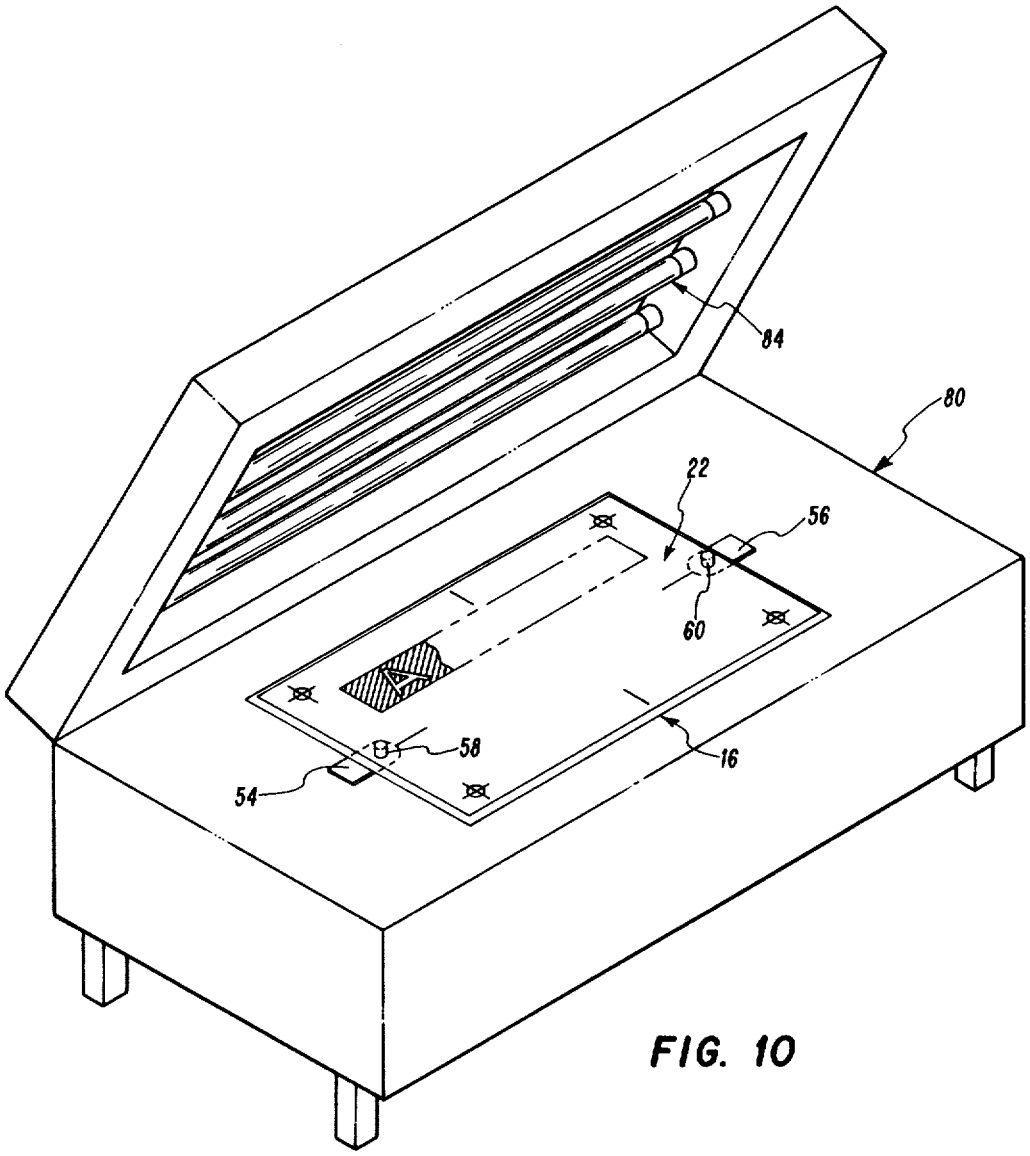
FIG. 10 is a perspective view of an exposure table on which a color separation negative and photopolymer plate are mounted in superimposed relation for exposure.
Figure 11:
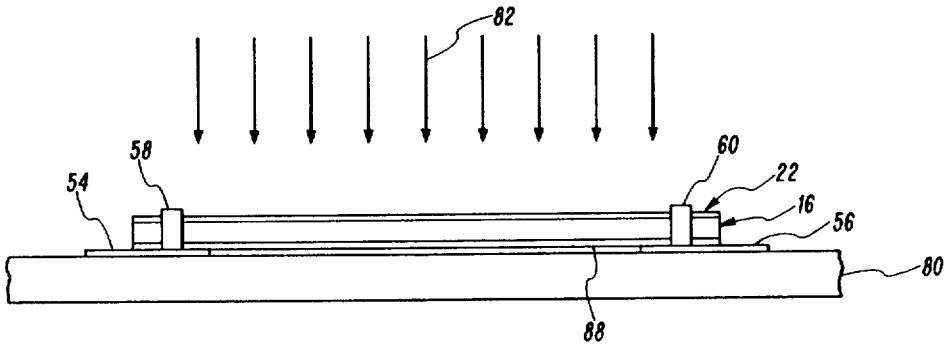
FIG. 11 is a simplified view, partly in section, of the exposure table shown in FIG. 6.

The assembly is then transferred to an exposure table 80 as illustrated in FIG. 10. According to this arrangement, the developed color separated film 22 is superimposed over the unexposed photopolymer plate 16, with the corresponding index holes being maintained in registration by pin register tabs 54, 56. The upright index pins 58, 60 mechanically couple the color separated negative 22 in superimposed relation with the underlying unexposed photopolymer plate 16. The pins 58, 60 maintain the respective holes exactly in registration during the exposure process.

The photopolymer plate 16 is thereafter exposed to ultraviolet light 82 which is directed through the color separation film from a suitable ultraviolet light source 84. As a result of this procedure, the color separation image A is transferred to the photopolymer plate 16. Previous to the exposure, the photopolymer plate is pre-exposed on the back side of the plate, a process commonly employed in conventional techniques of photopolymer plate making.

Figure 15:
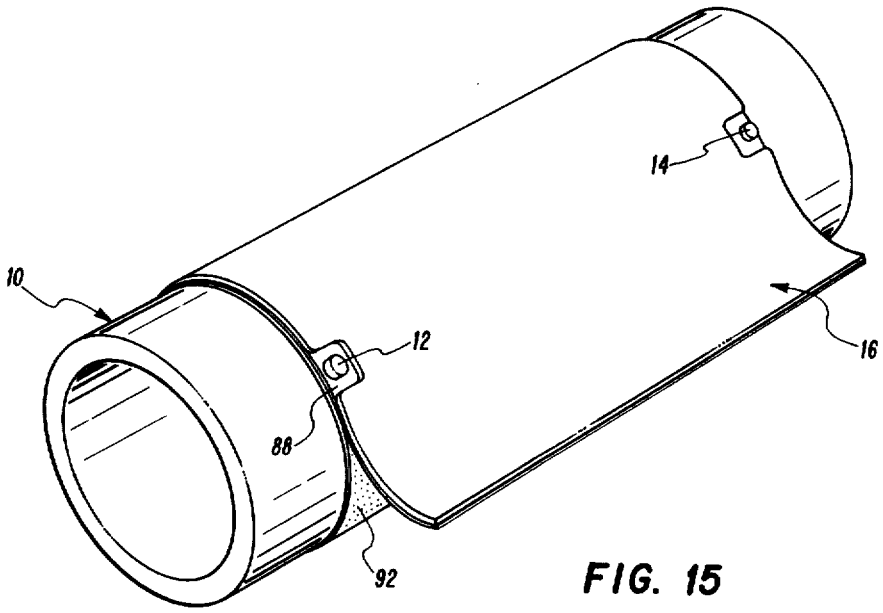

Referring now to FIGS. 13 and 15, the finished photopolymer 16 is thereafter mounted onto the print cylinder 10 with the index pins 12, 14 of the print cylinder being in registration with the index holes 18, 20. A simplified representation of the finished photopolymer plate is illustrated in FIG. 13, with etch cavities 84 separating print surfaces 86. In the various views in which the film and plate appear, the thicknesses have been exaggerated for illustration purposes. The thickness of the color separation film is typically 0.004 inch, while the thickness of the photopolymer plate 16 is typically 0.065 inch.

The photopolymer plate 16 is bonded onto a polyester film base 88 through which the holes 18, 20 are punched. The upper end 12A of the index pin 12 projects above the polyester film base 88 by a distance of approximately 0.035 inch, but lies below the level of the print surface 86. Thus, the upper end 12A of the index pin projects approximately 0.040 inch above the exterior surface of the print cylinder 10, with its root shaft 12B extending approximately 0.50 inch into the cylinder side wall. The bore 90 forms a pocket in which the root portion 12B is received. Cylindrical bores 90 are positioned at corresponding locations on each print cylinder with the aid of a template. Each bore 90 defines a slip pocket into which the index pins can be inserted and withdrawn.

After the print cylinder 10 has been drilled and the index pins 12, 14 have been installed, a layer 92 of double-sided contact adhesive tape is applied to the exterior surface of the print cylinder. The thickness of the adhesive tape is approximately 20 mils. After the layer 92 of the contact adhesive tape is applied to the surface of the print cylinder, the photopolymer plate 16 is manually positioned about the cylinder with the index pins 12, 14 being received in registration with the printing plate index holes 18, 20, as illustrated in FIG. 15. Pressure is applied to the photopolymer plate 16, forcing it into contact with the layer of adhesive tape, thereby securing the position of the plate.

The index pins 12, 14 are then removed (if removable pins are used) and the printing cylinder is then ready for production. If drilled and tapped index pins are used, the index pins are left in the cylinder but the heads must be below the pitch line of the printing plate.

The foregoing procedure is employed for each printing station, thereby creating a precise registration from one color to the next color.

As a result of the precision provided by the photographically aligned exposure field and index holes on each plate, and the corresponding identical locations of the index pins on each print cylinder, no further adjustment of the photopolymer plate 16 will be required. After bonding has been established, the index pins 12, 14 can be removed if desired. With each plate and print cylinder being set up in the foregoing manner, and assuming that the print cylinders are synchronized in rotation, the color impressions produced by the successive, superimposed printing fields will be properly spaced, thereby providing faithful color reproduction.

It will be appreciated that the print cylinders of a conventional flexographic press can be easily adapted to accomodate the method of the invention. The bore pockets for receiving the index pins can be drilled by a machinist using commonly available drill equipment. A template is used for precisely locating the index pin holes at identical locations on each of the print cylinders. Likewise, the flexographic plate index holes are formed with commonly available precision punch equipment.

Under initial conditions in which the print cylinders have been modified by installation of the index pins, and the color separation films have already been prepared, the remaining steps, including punching of index holes and actual mounting of the finished photopolymer plate onto a print cylinder can be carried out by a single operator in less than an hour. Moreover, because of the inherent precision provided by the pin register system, the exposure fields of the respective photopolymer plates are precisely aligned, so that alignment errors induced by the "parallax" effect are avoided, and personal judgment or skill of the operator is no longer a factor. Accordingly, once the photopolymer plate has been engaged by the index pins, further position adjustment is not likely to be required, with the result that the set-up time is reduced by a factor of 10 to 20, with the attendant savings in labor, and with reliable, faithful color reproduction being obtained.

Although a preferred embodiment of the invention has been described in detail, it should be understood that various changes, substitutions and alterations can be made therein without departing from the spirit and scope of the invention as defined by the appended claims.

I claim:

1. An improved print cylinder assembly including a roller having a tubular sidewall for supporting a flexographic printing plate, characterized in that:

said roller having first and second bores formed in said tubular sidewall at separate locations which are spaced apart by a distance L;

first and second index pins received within the first and second bores, respectively, each index pin having a head portion projecting outwardly from the tubular sidewall external surface;

a layer of adhesive material disposed about the external surface of said tubular sidewall;

a flexographic printing plate mounted on said roller sidewall having first and second index holes formed thereon at separate locations which are substantially spaced apart by a distance L corresponding to the spacing L of the first and second bores in said roller sidewall, said first and second index pins being received within said first and second index holes of the flexographic printing plate, and said flexographic printing plate being bonded to said tubular sidewall by said adhesive layer; and, said flexographic printing plate having a foundation sheet of flexible material contacting said adhesive material and a layer of photosensitive material bonded to said flexible foundation sheet, said first and second index holes being formed through said flexible foundation sheet, with a portion of the photosensitive material of said flexographic plate being removed from first and second areas coincident with said first and second index holes, respectively, thereby defining first and second windows coincident with said first and second index holes, respectively, said first and second index pins projecting into said first and second windows, respectively.

* * * * *

UNITED STATES PATENT AND TRADEMARK OFFICE

CERTIFICATE OF CORRECTION

PATENT NO. : 4,727,806

DATED : 3/1/88

INVENTOR(S) : Eugene L. Green, Sr.

It is certified that error appears in the above-identified patent and that said Letters Patent is hereby corrected as shown below:

Column 3, line 50, "purposs" should be -- purposes--.

Column 3, lines 65-66, "corresponds" should be -- correspond --.

Column 4, line 51, "38" should be -- 28 --.

Column 5, line 24, "thorugh" should be -- through --.

Signed and Sealed this

Twenty-eighth Day of June, 1988

*Attest:*

DONALD J. QUIGG

*Attesting Officer*

*Commissioner of Patents and Trademarks*